US007878673B2

(12) United States Patent
Kempkey et al.

(10) Patent No.: US 7,878,673 B2
(45) Date of Patent: Feb. 1, 2011

(54) SPA SPEAKER LIGHT

(75) Inventors: Mark Douglas Kempkey, San Diego, CA (US); Drew Robertson Verkade, Carlsbad, CA (US); Bradley Charles Steele, San Diego, CA (US); Christopher C. Larsen, Vista, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 27 days.

(21) Appl. No.: 12/196,503

(22) Filed: Aug. 22, 2008

(65) Prior Publication Data

US 2009/0284974 A1 Nov. 19, 2009

Related U.S. Application Data

(60) Provisional application No. 61/053,276, filed on May 15, 2008.

(51) Int. Cl.
*F21V 33/00* (2006.01)

(52) U.S. Cl. ..... 362/101; 362/555

(58) Field of Classification Search ..... 362/101, 362/267, 544, 555, 253, 311.05
See application file for complete search history.

(56) References Cited

U.S. PATENT DOCUMENTS 6,471,368 B1 * 10/2002 Lin ..... 362/216
6,502,976 B1 * 1/2003 Bernhard ..... 362/555
6,949,894 B1 * 9/2005 Sullivan et al. ..... 315/362
7,097,336 B2 * 8/2006 Lin ..... 362/544
7,407,311 B2 * 8/2008 Yang ..... 362/555
7,553,040 B2 * 6/2009 Boothe et al. ..... 362/101
2009/0154163 A1 * 6/2009 Wesselmeier ..... 362/253

OTHER PUBLICATIONS

John F. Van Derlofske, Computer modeling of LED light pipe systems for uniform display illumination. Lighting Research Center, Rensselaer Polytechnic Institute, Troy, NY 12180. Published in Solid State Lighting and Displays, Copyright 2001 Society of Photo-Optical Instrumentation Engineers.

* cited by examiner

*Primary Examiner*—Anabel M Ton
(74) *Attorney, Agent, or Firm*—Greenberg Traurig LLP; Franklin D. Ubell

(57) ABSTRACT

A spa speaker mounting and illumination receptacle includes a light transmitting circular flange and a circular light transmitting sidewall perpendicularly disposed to and supporting the flange, the sidewall including at least a first lamp receptacle and at least a first tapered portion, the first lamp receptacle being disposed to direct illumination from a lamp disposed therein into said first tapered portion, the first tapered portion being tapered to enhance the uniformity of distribution of illumination around the flange.

36 Claims, 3 Drawing Sheets

SPA SPEAKER LIGHT

RELATED APPLICATION DATA

This application claims the benefit of, and priority to, U.S. Provisional Application Ser. No. 61/053,276, filed May 15, 2008, entitled, "Spa Speaker Light," the contents of which is incorporated by reference herein in its entirety.

BACKGROUND

1. Field

The subject disclosure relates generally to spas, pools and the like and more particularly to apparatus for providing a pleasing illumination feature to enhance user enjoyment of portable spas.

2. Related Art

Efforts to enhance the portable spa user experience have included the provision of many features designed to enhance user enjoyment. Such features have included convenient control panel assembles, various spa jet designs and combinations, and stereo system features.

SUMMARY

The following is a summary description of an illustrative embodiment of the invention. It is provided as a preface to assist those skilled in the art to more rapidly assimilate the detailed design discussion which ensures and is not intended in any way to limit the scope of the claims which are appended hereto in order to particularly point out the invention.

In an illustrative embodiment according to the invention, an audio speaker mounting and illumination receptacle is provided comprising a light transmitting circular flange and a circular light transmitting sidewall disposed at an angle to and supporting the flange. The sidewall includes at least a first lamp receptacle and at least a first tapered portion, with the lamp receptacle being disposed to direct illumination from a lamp disposed therein into the tapered portion. The tapered portion is particularly tapered to enhance the uniformity of distribution of illumination around the circular flange. An audio speaker unit may then be mounted within the circular flange so that it is encircled by the illumination provided thereby to create a pleasing illumination effect. Other spa features such as valve handles or other equipment may be illuminated by other embodiments according to the invention.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
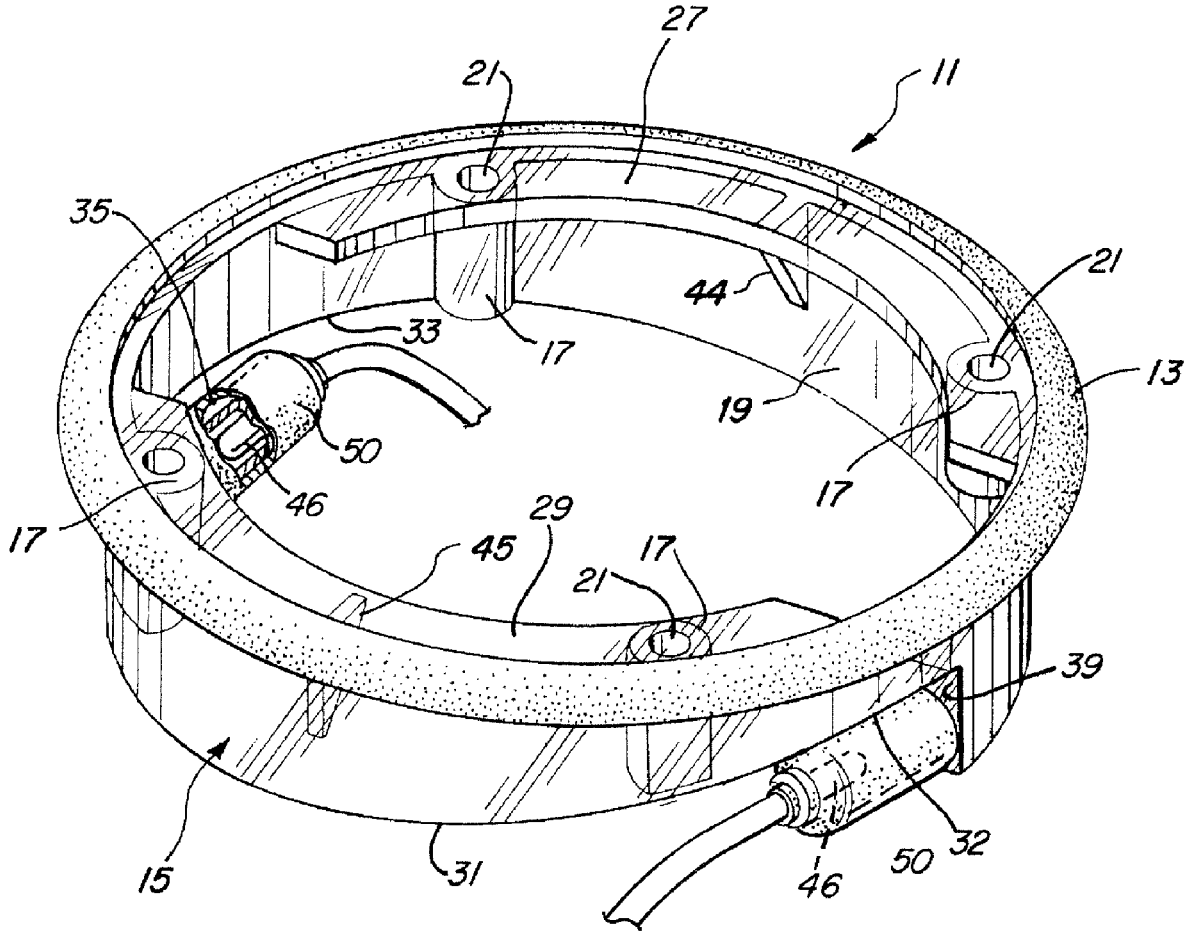
FIG. 1 is a perspective view of a speaker mounting and illumination receptacle according to an illustrative embodiment.

A spa speaker mounting and illumination receptacle 11 according to an illustrative embodiment is shown in FIG. 1. The receptacle 11 includes a textured or frosted circular mounting flange 13 and a vertical cylindrical sidewall 15 integrally molded with the mounting flange 13. Alternatively, the sidewall 15 could be a separate component adhesively or otherwise fastened to the flange 13.

A plurality of vertically disposed cylindrical wells or bosses 17 are formed at intervals around the perimeter of the interior 19 of the side wall 15. Each well 17 includes a central cylindrical through hole 21, each of which opens into a top face 23, 25 of a respective semicircular mounting ledge 27, 29.

Figure 2:
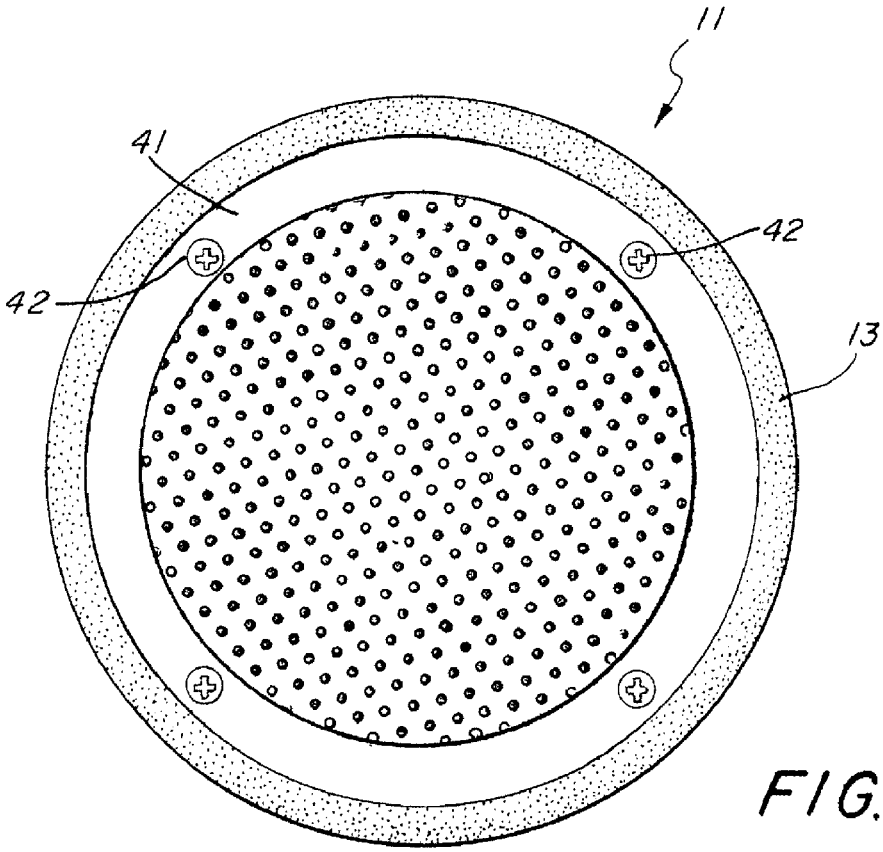
FIG. 2 and FIG. 3 are a top and bottom view, respectively, of the receptacle of FIG. 1.
Figure 3:
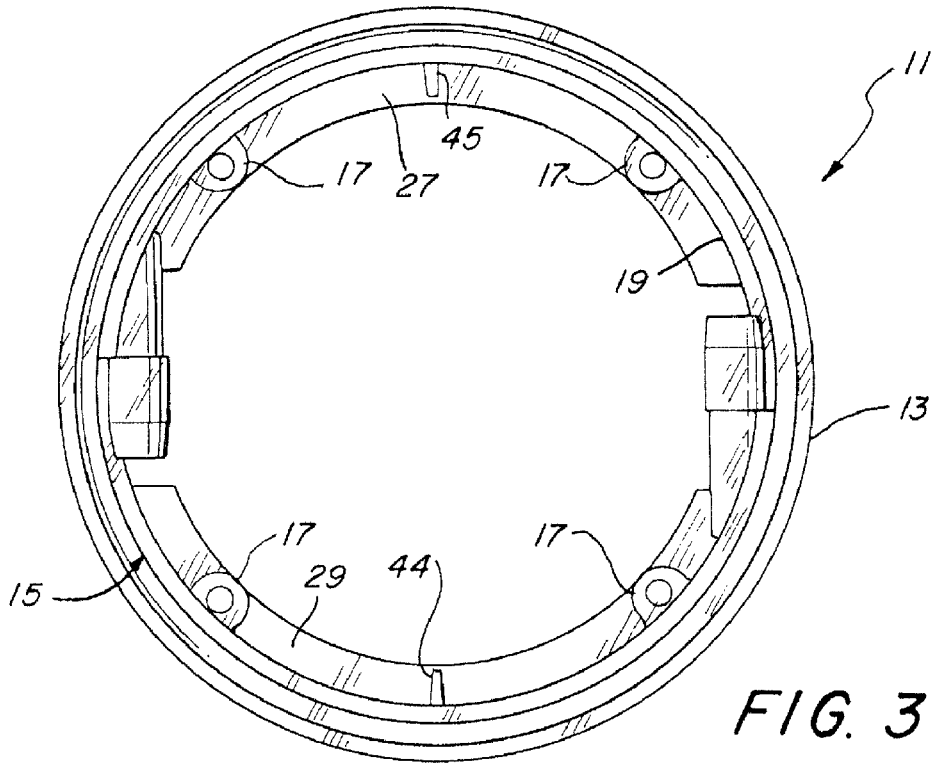
Figure 4:
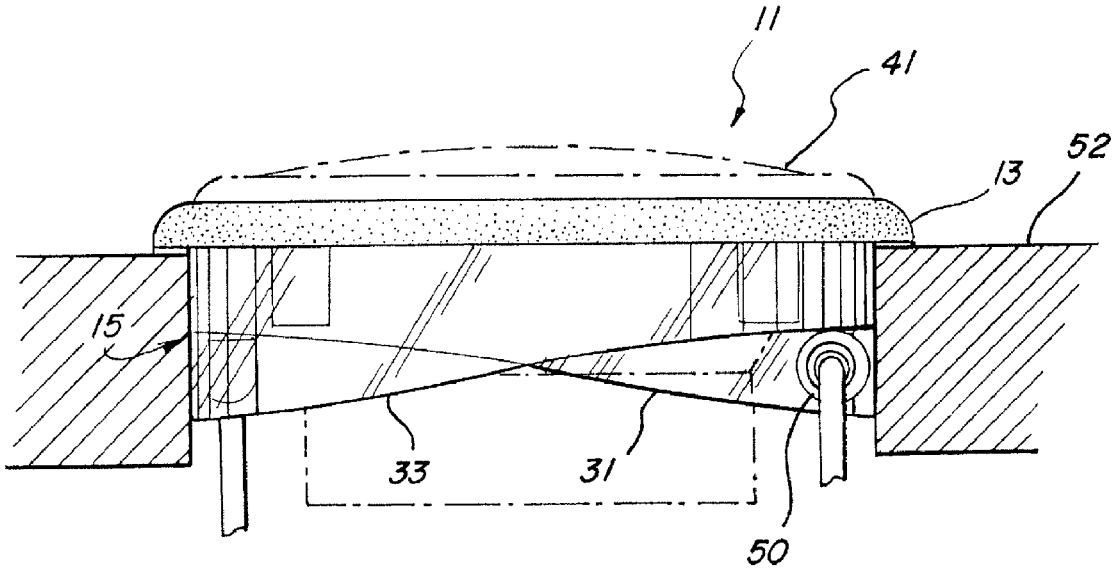
FIG. 4 is a first side view of the receptacle of FIG. 1.
Figure 5:
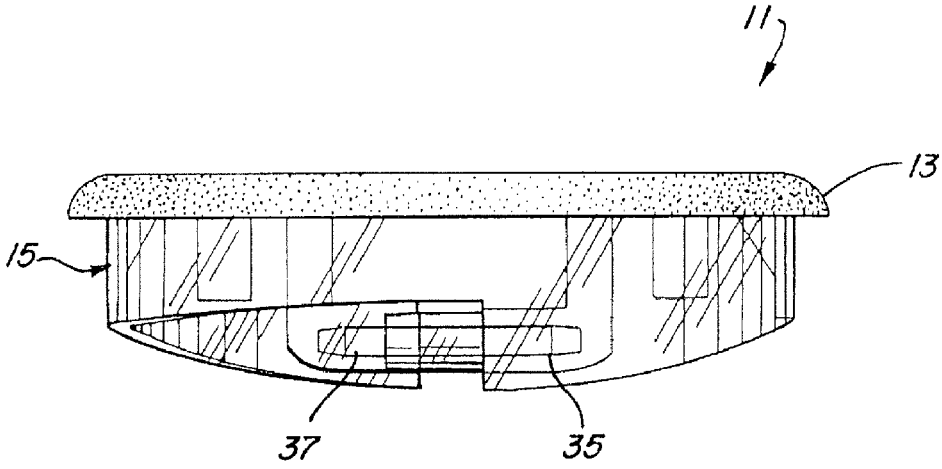
FIG. 5 is a second side view of the receptacle of FIG. 1.

The respective mounting ledges 27, 29 support an audio speaker unit 41 (FIG. 2), which is attached to the mounting receptacle 11 by suitable fasteners, e.g. 42, inserted through the speaker mounting holes and through the holes 21. First and second reinforcement ribs 44, 45 are provided beneath the ledges 27, 29 at locations 180° apart.

The sidewall 15 includes a tapered portion 31, 33 on opposite sides thereof. Each tapered portion 31, 33 curves upwardly, creating a space, e.g. 32, to position respective integrally molded lamp sockets 35, 37 at respective cross-sectional edges 39, 41 of the sidewall 15. Each lamp socket 35, 37 includes an opening 43, 45 therein, disposed perpendicularly to each cross-sectional edge 39, 41. Each opening is designed to receive a lamp unit, e.g. 46, preferably an LED of, for example, a 12 volt, 1 amp rating of any selected color. The lamp units 46 are enclosed within a flexible rubber or plastic shroud 50, which snugly fits over and about each projecting plastic lamp socket 35, 37. In the illustrative embodiment, the lamp sockets 35, 37 are positioned 180 degrees apart from one another.

The tapered portions 31, 33 of the side wall 15 are particularly shaped to enhance the uniformity of the illumination around the "light ring" created around the speaker unit or other component. In particular, rather than a straight horizontal edge or straight angled edge, the contour of the tapered edges 31,33 is curved, i.e. aspheric, so as to distribute illumination from the discrete LED sources uniformly around the ring 13 above them.

All portions of the speaker receptacle 11 are preferably molded from conventionally available plastic, such as, for example, a white translucent acrylic plastic material. The receptacle 11 could also be fabricated of polycarbonate, PVC, a blend or any plastic which suitably transmits light.

In illustrative use, the speaker receptacle 11 is installed in the wall 52 of a spa unit. A bead of silicone may be used to both attach the speaker receptacle 11 and waterproof the installation. A suitable speaker is then attached to the receptacle 11 and wired up. LED lamps 46 are then installed in the sockets 35, 37. When the lamps 46 are illuminated after dark, the translucent plastic receptacle 11 transmits and diffuses the LED illumination which is further diffused by the textured flange 13 so as to create a pleasing illuminated ring or "halo" around the speaker unit 41.

The receptacle 11 or other embodiments thereof may also be used to mount and illuminate other spa or pool equipment, such as for example, valve handles. The number of LED sockets may of course be varied, for example, as the diameter of the ring 11 increases.

Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. An apparatus comprising:

a light transmitting circular flange; and a circular light transmitting sidewall disposed at an angle to and supporting said flange; said sidewall including at least a first lamp receptacle and at least a first tapered portion having a side edge, said first lamp receptacle being positioned at said side edge to direct illumination from a lamp disposed therein sidewardly into said first tapered portion; said first tapered portion being tapered to enhance the uniformity of distribution of said illumination around said flange.

2. The apparatus of claim 1 wherein said sidewall further comprises a second lamp receptacle disposed to direct illumination from a lamp disposed therein into a second tapered portion, the second tapered portion being tapered to enhance the uniformity of distribution of illumination around said flange.

3. The apparatus of claim 2 wherein each of said first and second tapered portions curve upwardly thereby creating a space providing access to a respective one of said first and second lamp receptacles.

4. The apparatus of claim 3 wherein each of said first and second lamp receptacles has a horizontally oriented lamp-receiving opening.

5. The apparatus of claim 3 wherein one lamp receptacle is disposed 180 degrees apart from the other.

6. The apparatus of claim 1 wherein said circular flange has a light diffusing surface.

7. The apparatus of claim 1 wherein said flange has a textured surface.

8. The apparatus of claim 1 wherein said circular flange defines an inner circular opening and further including first and second mounting ledges projecting horizontally from an inner side of said sidewall into said opening.

9. The apparatus of claim 8 wherein said opening and mounting ledges are so shaped and dimensioned as to receive and position an audio speaker.

10. The apparatus of claim 2 further including first and second lamps disposed respectively in said first and second lamp receptacles.

11. The apparatus of claim 9 further including an audio speaker unit installed within said circular flange.

12. The apparatus of claim 10 further including a spa having a sidewall with an opening therein and wherein said circular flange, sidewall and said speaker unit are installed in said opening.

13. The apparatus of claim 12 wherein said sidewall is disposed perpendicularly to said flange.

14. The apparatus of claim 2 wherein said first and second tapered portions each have an aspheric contour.

15. An illuminatable receptacle for a spa speaker unit comprising:

an illuminatable light transmitting annular flange with a circular opening shaped to receive said spa speaker unit; and a circular light transmitting sidewall integrally molded with said annular flange and disposed vertically to and supporting said annular flange; said sidewall including at least a first lamp receptacle and at least a first tapered portion having a side edge, said first lamp receptacle being positioned at said side edge to direct illumination from a lamp disposed therein sidewardly into said first tapered portion.

16. The receptacle of claim 15 wherein said first tapered portion is tapered in such a manner as to enhance the uniformity of distribution of said illumination around said flange.

17. The receptacle of claim 16 wherein said sidewall further comprises a second lamp receptacle disposed to direct illumination from a lamp disposed therein horizontally into a second tapered portion, the second tapered portion being tapered to enhance the uniformity of distribution of illumination around said flange.

18. The receptacle of claim 17 wherein each of said first and second tapered portions curve upwardly thereby creating a space providing access to a respective one of said first and second lamp receptacles.

19. The receptacle of claim 18 wherein each of said first and second lamp receptacle has a horizontally oriented lamp-receiving opening.

20. The receptacle of claim 18 wherein one lamp receptacle is disposed 180 degrees apart from the other.

21. The receptacle of claim 15 wherein said circular flange has a light diffusing surface.

22. The receptacle of claim 15 wherein said flange has a textured surface.

23. The receptacle of claim 15 wherein said circular flange defines an inner circular opening and further including first and second mounting ledges projecting horizontally from an inner side of said sidewall into said opening.

24. The receptacle of claim 23 wherein said opening and mounting ledges are so shaped and dimensioned as to receive and position an audio speaker.

25. The receptacle of claim 17 further including first and second lamps disposed respectively in said first and second lamp receptacles.

26. The receptacle of claim 24 further including an audio speaker unit installed within said circular flange.

27. The apparatus of claim 25 further including a spa having a sidewall with an opening therein and wherein said circular flange, sidewall and said speaker unit are installed in said opening.

28. The apparatus of claim 17 wherein said first and second tapered portions each have an aspheric contour.

29. Apparatus for providing an illuminated ring around a spa speaker unit comprising:

a light transmitting circular flange having a circular opening shaped to receive said spa speaker unit; and a circular light transmitting sidewall disposed at an angle to and supporting said flange; said sidewall including at least a first lamp receptacle and at least a first tapered portion having a side edge, said first lamp receptacle being disposed to direct illumination from a lamp positioned at said side edge therein sidewardly into said first tapered portion.

30. The apparatus of claim 29 wherein said first tapered portion is tapered in such a manner as to enhance the uniformity of distribution of said illumination around said flange.

31. An apparatus comprising:

a light transmitting circular flange; and a circular light transmitting sidewall disposed beneath and at an angle to said flange, said sidewall further supporting said flange; said sidewall including at least a first lamp receptacle and at least a first tapered portion having a side edge, said first lamp receptacle being positioned at said side edge to direct illumination from a lamp disposed therein sidewardly into said first tapered portion.

32. The apparatus of claim 31 wherein said first tapered portion is tapered in such a manner as to enhance the uniformity of distribution of said illumination around said flange.

33. The apparatus of claim 30 wherein said light transmitting sidewall is disposed vertically and perpendicularly to said flange and wherein said first lamp receptacle is disposed to direct said illumination horizontally into said first tapered portion.

34. The apparatus of claim 33 wherein said first tapered portion is tapered in such a manner as to enhance the uniformity of distribution of said illumination around said flange.

35. An apparatus comprising:

a light transmitting circular flange; and a circular light transmitting sidewall disposed at an angle to and supporting said flange; said sidewall including at least a first lamp receptacle and at least a first light transmitting tapered portion having a side edge, said first lamp receptacle being positioned at said side edge to direct illumination from a lamp disposed therein sidewardly into and through said first light transmitting tapered portion of said light transmitting sidewall; said first tapered portion being tapered to enhance the uniformity of distribution of said illumination around said flange.

36. An illuminatable receptacle for a spa speaker unit comprising:

an illuminatable light transmitting annular flange with a circular opening shaped to receive said spa speaker unit; and a circular light transmitting sidewall integrally molded with said annular flange and disposed vertically to and supporting said annular flange; said sidewall including at least a first lamp receptacle and at least a first light transmissive tapered portion having a side edge, said first lamp receptacle being positioned at said side edge to direct illumination from a lamp disposed therein horizontally into and through said first tapered portion.

* * * * *